United States Patent [19]

Weise et al.

[11] Patent Number: 4,859,238

[45] Date of Patent: Aug. 22, 1989

[54] SILVER-IRON MATERIAL FOR ELECTRICAL CONTACTS

[75] Inventors: Wolfgang Weise, Frankfurt; Roger Wolmer, Hanau; Peter Braumann, Alzenau, all of Fed. Rep. of Germany

[73] Assignee: Degussa Aktiengesellschaft, Frankfurt, Fed. Rep. of Germany

[21] Appl. No.: 201,726

[22] Filed: Jun. 3, 1988

[30] Foreign Application Priority Data

Jun. 6, 1987 [DE] Fed. Rep. of Germany ..... 3719052

[51] Int. Cl.[4] ..... C22C 29/12

[52] U.S. Cl. ..... 75/233; 75/230; 75/232; 75/244; 419/13; 419/19; 419/21; 419/66; 252/513; 252/514

[58] Field of Search ..... 75/247, 232, 230, 233, 75/244; 419/21, 66, 13, 19; 252/513, 514

[56] References Cited

U.S. PATENT DOCUMENTS

| | | | |
|---|---|---|---|
| 2,394,501 | 2/1946 | Weiller | 75/247 |
| 2,664,618 | 1/1954 | Kleis | 75/247 |
| 3,401,024 | 9/1968 | Holt et al. | 75/247 |
| 3,951,872 | 4/1976 | Neely | 75/200 |
| 3,954,459 | 5/1976 | Schreiner | 75/206 |
| 3,957,453 | 5/1976 | Hassler et al. | 75/200 |
| 3,992,199 | 11/1976 | Neely | 75/200 |
| 4,141,727 | 2/1979 | Shida et al. | 75/232 |
| 4,204,863 | 5/1980 | Schreiner | 75/234 |
| 4,294,616 | 10/1981 | Kim et al. | 75/234 |
| 4,330,331 | 5/1982 | Fujiwara et al. | 75/206 |

*Primary Examiner*—Stephen J. Lechert, Jr.
*Attorney, Agent, or Firm*—Beveridge, DeGrandi & Weilacher

[57] ABSTRACT

Electrical contacts are formed from a silver-iron material which contains 3 to 30% by weight of iron and one or more of the components manganese, copper, zinc, antimony, bismuth oxide, molybdenum oxide, tungsten oxide or chromium nitride in amount totalling 0.05 to 5 weight percent, the balance being silver. These materials are suitable for forming electrical contacts of a wide variety. Tantalum is an optional component which may also be utilized particularly when 0.2 percent to 2 percent zinc is present.

10 Claims, 1 Drawing Sheet

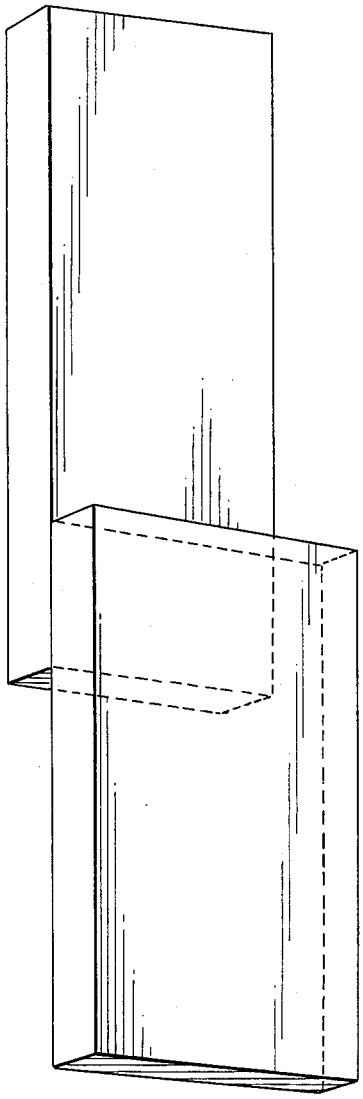

SILVER-IRON MATERIAL FOR ELECTRICAL CONTACTS

INTRODUCTION AND BACKGROUND

The present invention relates to the utilization of a silver-iron material having further additives for electrical contacts.

The essential requirements for an electrical contact material include a high resistance to arc erosion, resistance to welding and a low contact resistance. Depending on the actual demands placed on such objects in operation and the electrical current used, there can be obtained an evaluation with respect to the profile of the requirements for any given situation. For switch gears for low tension application it is known that silver-tin oxide ($Ag/SnO_2$) materials are suitable because of switch contacts made therefrom are high resistant to arc erosion and are highly resistant to welding when such contacts are closed to conduct, that is the materials ensure against welding. These are particularly good for electrical currents of 100–3000 A. For lower currents, a composite material of silver and nickel has been found suitable. This material, is compared to a fine silver product, exhibits a higher resistance to arc erosion without, however, experiencing any substantial increase in the contact resistance.

A further and frequently utilized composite material is silver-tungsten (Ag/W) which has a high resistance to arc erosion. However when frequent switching connections are made during exposure to air, there is created a surface layer of silver-tungstenate which leads to an increase in the contact resistance.

From the Japanese patent application No. 79/148-109 it is known to provide electrical contact materials which possess in addition to silver the addition materials of iron, nickel, chromium and/or cobalt. In particular, materials which have the composition Ag10Fe display a high resistance to welding and yet have a good electrical conductivity.

Notwithstanding this development, these previously known materials have long failed to achieve a wide utilization, which drawback can be attributable to the formation of oxide layers and which then lead to high contact temperatures.

SUMMARY OF THE INVENTION

It is therefore an object of the present invention to provide a silver-iron material suitable for electrical contacts which material has a low tendency to weld a minimum contact resistance and a low contact heating effect as well as a long life time and a wide field of application in regard to the strength of the electrical current.

In achieving the above and other objects of the invention, a feature of the present invention resides in the utilization of a silver-iron material which contains 3 to 30 weight percent iron and one or more of the following additional components; namely, manganese, copper, zinc, antimony, bismuth oxide, molybdenum oxide, tungsten oxide, chromium nitride, and mixtures thereof, in amounts which total 0.05 to 5 weight percent.

BRIEF DESCRIPTION OF THE DRAWING

The drawing is a schematic view of an electrical contact in the shape of a rectangular bar.

DETAILED DESCRIPTION OF INVENTION

In accordance with the invention there is surprisingly obtained with these materials a lowering of the contact resistance and thereby the contact heating, without a sacrifice of the good safety against welding together of the contacts. The improvement in the contact heating in comparison to silver-iron (90:10) is up to 43%. This improvement is arrived at through an efficient influence on the development of the formation of the iron-oxide layers. Whereas the material silver-iron—90:10 without any additives does display a complete oxide covering, through the utilization of the heretofore named additive materials this oxide layer is influenced so that there is obtained a lower contact resistance in combination with a very good security against undesired fusing or self-welding.

In accordance with the preferred aspect of the invention, there has been found to be particularly useful a material having 3 to 20% iron and one or more of the additives manganese, copper, zinc, bismuth oxide ($Bi_2O_3$), molybdenum oxide ($MoO_3$), tungsten oxide ($WO_3$) and/or chromium nitride (CrN) in an amount which totals 0.2 to 2 weight percent. In particular, it has been established that it is preferable to add to the silver, in addition to the 3 to 20% iron, either 0.2 to 2 percent of metallic additives only or 0.2 to 2 percent of non-metallic additives only.

Materials have shown desirable properties which contain in addition to 3 to 20% iron, from 0.2 to 2 percent of one of the additives, manganese, copper, zinc, antimony, bismuth oxide, molybdenum oxide or tungsten oxide and the balance being silver. Preferably these materials contain in addition to 3 to 20% iron, from 0.2 to 2 percent zinc and optionally contain 0 to 2% copper, tantalum and/or antimony, the balance being silver; or alternatively 0.2 to 2% molybdenum oxide and the balance being silver.

Because of insolubility of iron in silver, these materials cannot be produced utilizing melting processes. Thus the preparation of such materials is carried out with known powder metallurgical processes. In that connection it has been shown to be advantageous when the iron powder that is used is not greater than 32 μm. In that way, one will be able to obtain a very uniform distribution of the iron particles in the mixture and a compounding effect with the additional materials so that there is obtained a very limited amount of surface layers developed with the switching.

Utilizing the work material described a number of electrical switching experiments were carried out. In addition to a determination of the contact resistance in the model experiment there was also determined the contact heating effect in a standard type switch gear.

The characteristics of the experiment are set forth in the following table which shows an improvement in the present invention with respect to contact resistance as compared to the known material Ag/Fe-90/10.

As will be apparent to those skilled in the art, the materials of the invention can be used to form electrical contacts of all conventional shape such as a rectangular bar shown in the drawing.

Further variations and modifications of the foregoing will be apparent to those skilled in the art and are intended to be encompassed by the appended claims.

German priority application No. P 37 19 052.0-34 is incorporated herein by reference.

TABLE

| Material | | RK max. 99% Value |
|---|---|---|
| Ag/Fe | −90/10 | 10.9 |
| Ag/Fe/Mn | −90/9.5/0.5 | 4.1–8.5 |
| Ag/Fe/Cu | −90/9.5/0.5 | 7.9 |
| Ag/Fe/Cu/Zn | −90/9/0.5/0.5 | 5.6 |
| Ag/Fe/Zn | −90/9/1 | 8.0 |
| | −80/19/1 | 13.3 |
| Ag/Fe/Zn/Ta | −90/9/0.5/0.5 | 7.8 |
| Ag/Fe/Sb | −90/9.5/0.5 | 8.9 |
| Ag/Fe/MoO3 | −90/9.7/0.3 | 9.6 |
| | −90/9/1 | 8.0 |
| Ag/Fe/WO3 | −90/9/0.5 | 8.5 |
| Ag/Fe/CrN | −90/9.5/0.5 | 8.2 |

We claim:

1. A material suitable for the formation of electrical contacts comprising 3 to 30 weight percent iron, and one or more of the additives manganese, copper, zinc, antimony, bismuth oxide, molybdenum oxide, tungsten oxide, chromium nitride in a total amount of 0.05 to 5 weight percent and the balance being silver.

2. The material as set forth in claim 1, wherein the additives are present in an amount of 0.2 to 2 weight percent.

3. The material of claim 1 which contain 0.2 to 2 percent manganese, copper, zinc, and/or antimony and the balance silver.

4. The material as set forth in claim 1 which contains 0.2 to 2 percent bismuth oxide, molybdenum oxide and/or tungsten oxide and the balance silver.

5. The material of claim 1 which additionally contains from 0 to 2 percent tantalum.

6. The material as set forth in claim 5 which contains 0.2 to 2 percent zinc and 0 to 2 percent copper, antimony and or tantalum.

7. The material in accordance with claim 1 which contains 0.2 to 2 percent molybdenum oxide and the balance silver.

8. An electrical contact made from the composition in accordance with claim 1.

9. A method of making an electrical contact comprising forming a mixture of powdered components having the following composition:

3 to 30% by weight iron, one or more finely divided manganese, copper, zinc, antimony, bismuth oxide, molybdenum oxide, tungsten oxide and chromium nitride in a total amount of 0.05 to 5 weight percent and the balance silver, shaping the powdered mixture and forming the desired electrical contact from said mixture.

10. A rectangular bar electrical contact formed from a composition of claim 1.

* * * * *